US009476581B2

(12) United States Patent
Wu

(10) Patent No.: US 9,476,581 B2
(45) Date of Patent: Oct. 25, 2016

(54) DUSTPROOF AND WATERPROOF MULTIPURPOSE LED-LIGHT POWER SOURCE ASSEMBLY AND DUSTPROOF AND WATERPROOF LED LIGHT

(75) Inventor: Chun-wei Wu, Guangzhou (CN)

(73) Assignee: NANKER (GUANG ZHOU) SEMICONDUCTOR MANUFACTURING CORP., Guangdong (CN)

( * ) Notice: Subject to any disclaimer, the term of this patent is extended or adjusted under 35 U.S.C. 154(b) by 395 days.

(21) Appl. No.: 14/233,717

(22) PCT Filed: May 13, 2012

(86) PCT No.: PCT/CN2012/075418
§ 371 (c)(1),
(2), (4) Date: Mar. 4, 2014

(87) PCT Pub. No.: WO2012/155816
PCT Pub. Date: Nov. 22, 2012

(65) Prior Publication Data

US 2014/0307441 A1 Oct. 16, 2014

(30) Foreign Application Priority Data

May 18, 2011 (CN) ..... 2011 1 0129366
Oct. 2, 2011 (CN) ..... 2011 1 0304298

(51) Int. Cl.
*F21V 29/67* (2015.01)
*F21V 31/00* (2006.01)
(Continued)

(52) U.S. Cl.
CPC ..... *F21V 29/67* (2015.01); *F21K 9/13* (2013.01); *F21V 17/12* (2013.01); *F21V 23/009* (2013.01);
(Continued)

(58) Field of Classification Search
CPC .... F21V 29/203; F21V 29/508; F21V 29/60; F21V 29/77; F21V 29/773; F21V 29/677; F21V 29/80; F21V 23/009; F21V 23/007; F21V 5/007; F21V 31/005; F21K 9/13
See application file for complete search history.

(56) References Cited

U.S. PATENT DOCUMENTS 2,279,170 A * 4/1942 Kraut ..... 174/163 R
5,794,685 A * 8/1998 Dean ..... 165/121
(Continued)

FOREIGN PATENT DOCUMENTS

CN 1632663 A 6/2005
CN 101382270 A 3/2009
(Continued)

OTHER PUBLICATIONS

International Search Report mailed Aug. 30, 2012 for the corresponding PCT Application No. PCT/CN2012/075418.

*Primary Examiner* — Robert May
*Assistant Examiner* — Leah S Macchiarolo
(74) *Attorney, Agent, or Firm* — Leason Ellis LLP

(57) ABSTRACT

A dustproof and waterproof multipurpose LED-light power source assembly comprises a heat sink, a heat-dispersal fan, a circuit board driver module, an LED light source module, a power-source casing top cover and a power-source casing bottom cover. The LED light source module comprises plural LED chips and an LED heat-dispersing substrate. The heat-dispersal fan is a dustproof and waterproof fan. The heat sink comprises a baseboard to which the LED heat-dispersing substrate is fixedly connected and conducts dispersed heat. At the center of the top of a heat-dispersal member, a space is provided to accommodate the heat-dispersal fan. The power-source casing bottom cover is positioned above the heat-dispersal fan and is fixedly connected to the heat sink. The power-source casing top cover and the power-source casing bottom cover are hermetically connected one to the other. A waterproof bolt assembly is connected to the top of the power-source casing top cover.

10 Claims, 11 Drawing Sheets

(51) Int. Cl.

| | |
|---|---|
| ***F21K 99/00*** | (2016.01) |
| ***F21V 17/12*** | (2006.01) |
| ***F21V 29/00*** | (2015.01) |
| ***F21V 23/00*** | (2015.01) |
| *F21Y 101/02* | (2006.01) |
| *F21Y 105/00* | (2016.01) |
| *F21V 5/00* | (2015.01) |
| *F21V 29/77* | (2015.01) |
| *F21V 29/80* | (2015.01) |

(52) U.S. Cl.

CPC ..... *F21V 29/2212* (2013.01); *F21V 29/677* (2015.01); *F21V 31/005* (2013.01); *F21V 5/007* (2013.01); *F21V 29/773* (2015.01); *F21V 29/80* (2015.01); *F21Y 2101/02* (2013.01); *F21Y 2105/001* (2013.01)

(56) References Cited

U.S. PATENT DOCUMENTS

| | | | | |
|---|---|---|---|---|
| 2010/0237782 | A1 | 9/2010 | Horng et al. | |
| 2010/0270922 | A1* | 10/2010 | Lin | 315/32 |
| 2011/0095690 | A1* | 4/2011 | Sagal | 315/113 |
| 2011/0169391 | A1* | 7/2011 | Mo et al. | 313/46 |
| 2011/0242828 | A1* | 10/2011 | Blincoe et al. | 362/373 |
| 2012/0038272 | A1* | 2/2012 | De Castro | 315/35 |
| 2012/0044642 | A1* | 2/2012 | Rodriguez | 361/692 |
| 2014/0211478 | A1* | 7/2014 | Park et al. | 362/294 |
| 2016/0003462 | A1* | 1/2016 | Zeng | F21V 29/63 |

FOREIGN PATENT DOCUMENTS

| | | | |
|---|---|---|---|
| CN | 101660743 | A | 3/2010 |
| CN | 101706091 | A | 5/2010 |
| CN | 201593707 | U | 9/2010 |
| CN | 201696921 | U | 1/2011 |
| CN | 102155699 | A | 8/2011 |
| CN | 102352975 | A | 2/2012 |
| CN | 102434799 | A | 5/2012 |
| CN | 202228980 | U | 5/2012 |
| JP | 2008-103195 | A | 5/2008 |

* cited by examiner

DUSTPROOF AND WATERPROOF MULTIPURPOSE LED-LIGHT POWER SOURCE ASSEMBLY AND DUSTPROOF AND WATERPROOF LED LIGHT

CROSS-REFERENCE TO RELATED PATENT APPLICATIONS

This application is a U.S. National Phase application under 35 U.S.C. §371 of International Patent Application No. PCT/CN2012/075418, filed May 13, 2012, and claims the benefit of Chinese Patent Applications No. 201110129366.5, filed on May 18, 2011 and No. 201110304298.1, filed Oct. 2, 2011, all of which are incorporated by reference in their entirety herein. The International Application was published on Nov. 22, 2012 as International Publication No. WO/2012/155816 under PCT Article 21(2).

FIELD OF THE INVENTION

The present invention relates to a dustproof and waterproof multipurpose LED-light power source assembly, further to a dustproof and waterproof LED light.

BACKGROUND OF THE INVENTION

With advantages such as high luminous efficiency, energy saving and long service life, light emitting diode, or LED, has been widely applied. For daily lighting, an LED lamp usually integrates a plurality of power LEDs in order to meet the illumination requirement, and heat dissipation of the LEDs turns out to be an important factor affecting use status and service life of an LED lamp. Consequently, the cooling problem becomes a technological bottleneck impeding extensive application of high-power LED lamps. LED lamps in the prior art are passively cooled down by devices like heat dissipation plates of a heat sink, and the only way to improve the cooling efficiency is to maximize the cooling area. Accordingly, LED lamps in the prior art generally have a large size because of a complicated cooling structure, and yet the cooling efficiency is unsatisfactory. The applicant of the present invention has developed an LED lamp with combined active and passive heat dissipation by integrating a cooling fan with a heat sink, which exhibits excellent cooling efficiency with effectively improved stability and extended service life. However, lamps of very high power such as high bay lights require even better cooling efficiency and therefore usually adopt an open type structure that results in poor waterproof and dustproof effect, impeding their application under outdoor and special environment.

In addition, a thermal silicone grease with a thermal conductivity of 3 W/(m·K)-4 W/(m·K) and a thermal insulating cloth with a thermal conductivity of 2 W(m·K)-3 W/(m·K) are currently used between a light source board and a heat sink for insulation and thermal conduction, both having a rather low thermal conductivity and thus exhibiting rather poor conductive efficiency. A thermal silicone grease is a fluid paste hard to apply evenly, and this will not only lower its thermal conductivity, but also impair the insulation performance between the light source board and the heat sink, or even cause a short circuit between the two. A thermal insulting cloth is also hard to apply evenly as it may be easily deformed, and is not efficient to use as it is hard to place it between the light source board and the heat sink.

SUMMARY OF THE INVENTION

The present invention intends to overcome deficiencies of the prior art and provide a dustproof and waterproof multipurpose LED-light power source assembly that is easy to install and has a high production efficiency as well as great dustproof and waterproof effects.

This invention also provides a dustproof and waterproof LED light with great cooling, waterproof and dustproof effects.

A dustproof and waterproof multipurpose LED-light power source assembly according to the present invention employs the following technical solutions. The dustproof and waterproof multipurpose LED-light power source assembly according to the present invention comprises a heat sink, a cooling fan, a driving circuit board module, an LED light source module, a power supply box top cover, a power supply box bottom cover, and a waterproof bolt assembly. The LED light source module comprises a plurality of LED chips and an LED heat dissipation substrate. The cooling fan is dustproof and waterproof. The heat sink comprises a base plate with which the LED heat dissipation substrate is fixedly connected to conduct heat for dissipation. The base plate has a flat bottom surface and a top surface with a heat dissipation portion of which the central top is provided with a space area for accommodating the cooling fan. The power supply box bottom cover is above the cooling fan and is fixedly connected with the heat sink. The power supply box top cover is sealedly connected with the power supply box bottom cover to enclose the driving circuit board module. The waterproof bolt assembly is connected to the top of the power supply box top cover.

The heat sink has a circular outer contour, the heat dissipation portion comprises a plurality of outer heat dissipation members at the top margin of the base plate and a plurality of inner heat dissipation members at the top center of the base plate, the outer heat dissipation members are sheet-like and are radially arranged along the base plate, air passages are formed between adjacent outer heat dissipation members, and the inner heat dissipation members are needle-like.

A synthetic mica sheet is placed between the LED heat dissipation substrate and the base plate, with an edge exceeding that of the LED heat dissipation substrate by 1-10 mm.

The LED heat dissipation substrate and the base plate are fixed together by a plurality of first screws, and insulating rubber particles are provided where the first screws are used to fix the connection so as to insulate the LED heat dissipation substrate from the first screws and the base plate.

The dustproof and waterproof multipurpose LED-light power source assembly further comprises an insulating annular panel in a space sealedly formed by the power supply box top cover and the power supply box bottom cover, and the driving circuit board module is positioned within the insulating annular panel.

The dustproof and waterproof multipurpose LED-light power source assembly further comprises a lens and a decorative ring, both fixedly connected to the bottom of the heat sink by second screws, and a silicone waterproof gasket is provided where the lens is connected to the bottom of the heat sink.

The inlet and outlet of the cooling fan are respectively provided with a fan net, and a plurality of third screws successively pass through the fan net above the cooling fan, the cooling fan, and the fan net below the cooling fan to get fixedly connected to the heat sink.

The power supply box top cover and the power supply box bottom cover are both round, and a waterproof sealant is applied to the seam between the two.

At least two support columns protruding from the heat dissipation portion are provided on the back of the heat sink to support the power supply box bottom cover, a plurality of bolts having internal threads in the leading end and external threads in the trailing end pass through the power supply box bottom cover to get fixedly connected to the support columns, a plurality of fifth screws pass through the driving circuit board module to get fixedly connected to the internal threads in the leading ends of the bolts, the support column is 10-50 mm higher than the upper surface of the cooling fan, and the leading end of the bolt with internal threads has a height of 5-10 mm.

The dustproof and waterproof LED light according to the present invention employs the following technical solutions. The dustproof and waterproof LED light according to the present invention comprises a dustproof and waterproof multipurpose LED-light power source assembly as well as an air guide housing, a top cover and a power line. The dustproof and waterproof multipurpose LED-light power source assembly comprises a heat sink, a cooling fan, a driving circuit board module, an LED light source module, a power supply box top cover, a power supply box bottom cover, and a waterproof bolt assembly. The LED light source module comprises a plurality of LED chips and an LED heat dissipation substrate. The cooling fan is dustproof and waterproof. The heat sink comprises a base plate with which the LED heat dissipation substrate is fixedly connected to conduct heat for dissipation. The base plate has a flat bottom surface and a top surface with a heat dissipation portion of which the central top is provided with a space area for accommodating the cooling fan. The power supply box bottom cover is above the cooling fan and is fixedly connected with the heat sink. The power supply box top cover is sealedly connected with the power supply box bottom cover to enclose the driving circuit board module. The waterproof bolt assembly is connected to the top of the power supply box top cover. The air guide housing is fixedly connected to the heat sink to enclose in its cavity the cooling fan, the power supply box top cover, the power supply box bottom cover, and the space above the heat sink. The air guide housing is provided with a plurality of air guide apertures on the upper sidewall. The top cover is fixedly connected to the air guide housing to laterally enclose the air guide apertures that communicates with the outside air through an opening around the bottom of the top cover. The power line successively passes through the top cover, the air guide housing and the power supply box top cover to get electrically connected to the driving circuit board module and then passes through the power supply box bottom cover to get electrically connected to the cooling fan and the LED light source module. A waterproof bolt assembly sealedly fixes where the power line passes through the power supply box top cover. A waterproof sealant sealedly fixes where the power line passes through the power supply box bottom cover.

The heat sink has a circular outer contour, the heat dissipation portion comprises a plurality of outer heat dissipation members at the top margin of the base plate and a plurality of inner heat dissipation members at the top center of the base plate, the outer heat dissipation members are sheet-like and are radially arranged along the base plate, air passages are formed between adjacent outer heat dissipation members, and the inner heat dissipation members are needle-like.

A synthetic mica sheet is placed between the LED heat dissipation substrate and the base plate, with an edge exceeding that of the LED heat dissipation substrate by 1-10 mm.

The LED heat dissipation substrate and the base plate are fixed together by a plurality of first screws, and insulating rubber particles are provided where the first screws are used to fix the connection so as to insulate the LED heat dissipation substrate from the first screws and the base plate.

The dustproof and waterproof multipurpose LED-light power source assembly further comprises an insulating annular panel in a space sealedly formed by the power supply box top cover and the power supply box bottom cover, and the driving circuit board module is positioned within the insulating annular panel.

The dustproof and waterproof multipurpose LED-light power source assembly further comprises a lens and a decorative ring, both fixedly connected to the bottom of the heat sink by second screws, and a silicone waterproof gasket is provided where the lens is connected to the bottom of the heat sink.

The inlet and outlet of the cooling fan are respectively provided with a fan net, and a plurality of third screws successively pass through the fan net above the cooling fan, the cooling fan, and the fan net below the cooling fan to get fixedly connected to the heat sink.

The power supply box top cover and the power supply box bottom cover are both round, and a waterproof sealant is applied to the seam between the two.

At least two support columns protruding from the heat dissipation portion are provided on the back of the heat sink to support the power supply box bottom cover, a plurality of bolts having internal threads in the leading end and external threads in the trailing end pass through the power supply box bottom cover to get fixedly connected to the support columns, a plurality of fifth screws pass through the driving circuit board module to get fixedly connected to the internal threads in the leading ends of the bolts, the support column is 10-50 mm higher than the upper surface of the cooling fan, and the leading end of the bolt with internal threads has a height of 5-10 mm.

The dustproof and waterproof LED light further comprises a transparent protective casing and a lampshade, both of which are fixedly connected to the bottom of the heat sink to enclose the LED light source module. The skirt of the bottom of the transparent protective casing caps the margin of the bottom of the lampshade so that the transparent protective casing and the lampshade can be connected to the heat sink by bolts. A waterproof sealant is applied to the seam between the skirt of the bottom of the transparent protective casing and the heat sink.

The present invention has advantageous effects as below. The dustproof and waterproof multipurpose LED-light power source assembly according to this invention comprises a heat sink, a cooling fan, a driving circuit board module, an LED light source module, a power supply box top cover, a power supply box bottom cover and a waterproof bolt assembly, the LED light source module comprising a plurality of LED chips and an LED heat dissipation substrate, the cooling fan being dustproof and waterproof, the heat sink comprising a base plate with which the LED heat dissipation substrate is fixedly connected to conduct heat for dissipation, the base plate having a flat bottom surface and a top surface with a heat dissipation portion, of which the central top is provided with a space area for accommodating the cooling fan, the power supply box bottom cover being above the cooling fan and being fixedly connected with the heat sink, the power supply box top cover being sealedly connected with the power supply box bottom cover to enclose the driving circuit board module, and the waterproof bolt assembly being connected to the top of the power supply box top cover. On account of the above, a power supply portion insulated from dust and water is obtained in the present invention by means of sealedly connecting the power supply box top cover with the power supply box bottom cover to enclose the driving circuit board module, connecting a waterproof bolt assembly to the top of the power supply box top cover, and sealing the power line with the waterproof bolt assembly, and a fan portion insulated from dust and water is also obtained by using a cooling fan that is dustproof and waterproof, thereby sealing and insulating the whole light power supply assembly from water and dust. The light power supply assembly rid of risks such as insects entering the power supply portion can be used as a primary element in street lamps, ceiling lamps, downlights, or high bay lights for outdoor lighting or locations like dusty workshops and plants. Heat dissipation of the lamp is combined with active and passive cooling by integrating the cooling fan with the heat sink, which is highly efficient and helps to effectively improve stability of the lamp and extend service life of the lamp. To sum up, the present invention is easy to install and has a high production efficiency as well as great dustproof and waterproof effects, and thus can be used in many ways.

A synthetic mica sheet is placed between the LED heat dissipation substrate and the base plate, with an edge exceeding that of the LED heat dissipation substrate by 1-10 mm. The synthetic mica sheet is a sheet-like insulating material produced by pressing mica papers made of mica raw materials together with adhesives under high temperature and high pressure. The synthetic mica sheet is excellent in thermal conductivity, flame resistance and electric insulation with advantages such as uniform thickness, adjustable area, and great flexibility and workability. It has a thermal conductivity of 5 W/(m·K)-24 W/(m·K), which is higher than that of a thermal silicone grease or a thermal insulating cloth. Besides, the mica sheet has a fixed shape and a high average uniformity, so it contacts with the LED heat dissipation substrate and the base plate in a tighter and more uniform way, and has a better thermal conductivity and a better insulativity. Further, the mica sheet is easy to install and has a high production efficiency. With the edge of the mica sheet exceeding the edge of the LED heat dissipation substrate by 1-10 mm, the requirement for creepage distance between LED heat dissipation substrate and the heat sink is met for safety. In conclusion, this invention has great thermal conductivity and insulativity.

For the same reasons, the dustproof and waterproof LED light according to the present invention has great cooling, waterproof and dustproof effects.

BRIEF DESCRIPTION OF DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
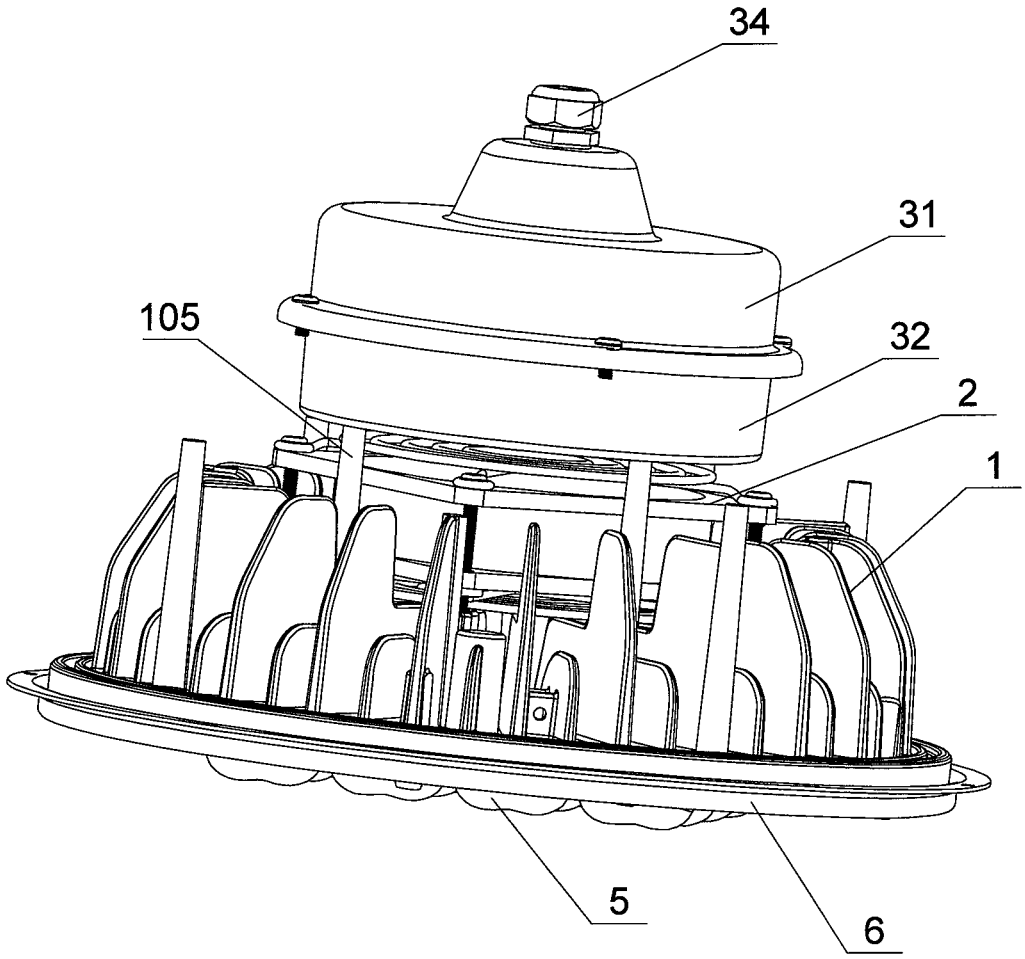
FIG. 1 is a three-dimensional structure diagram of a dustproof and waterproof multipurpose LED-light power source assembly implementing the present invention.
Figure 2:
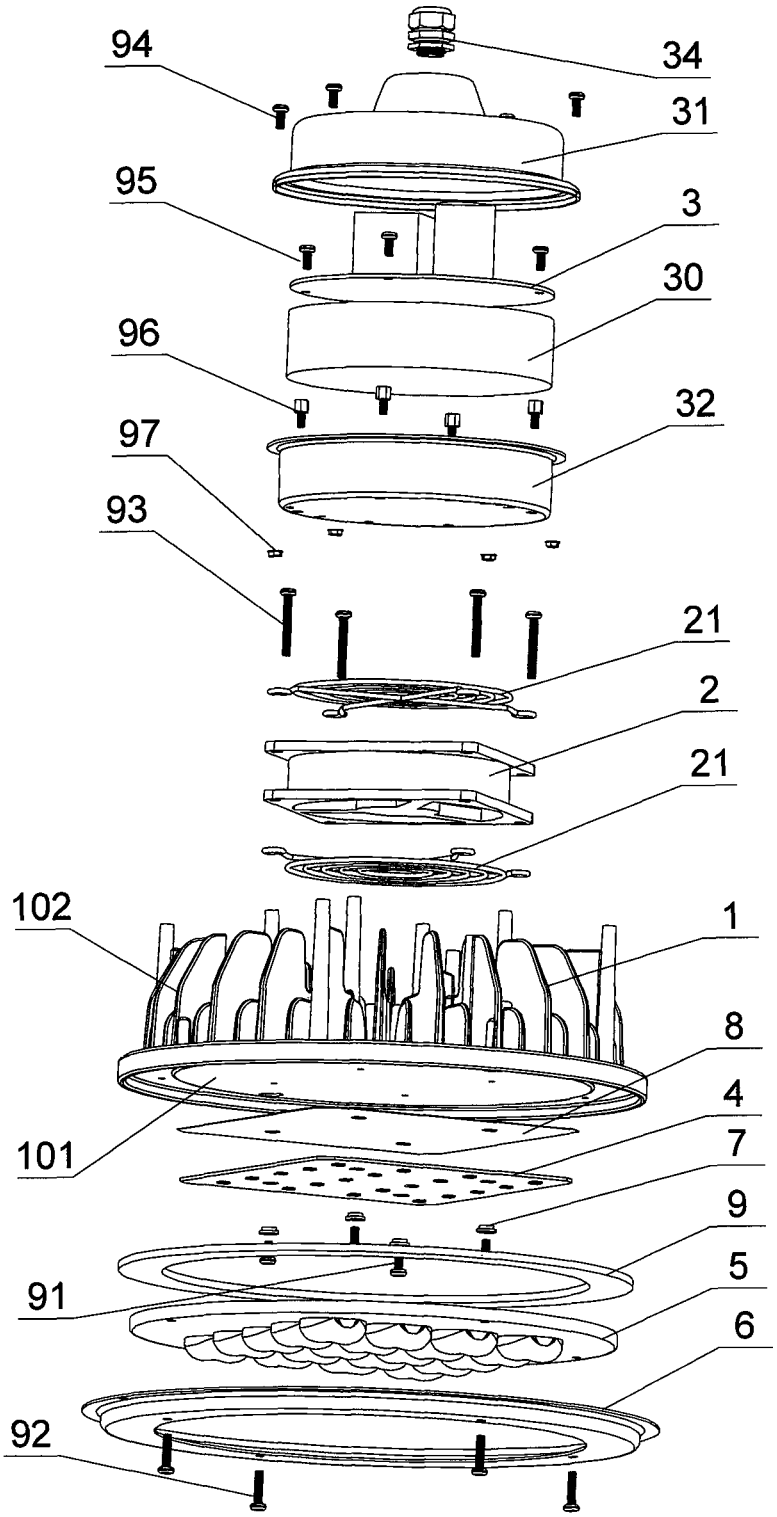
FIG. 2 is an exploded diagram of the dustproof and waterproof multipurpose LED-light power source assembly.
Figure 3:
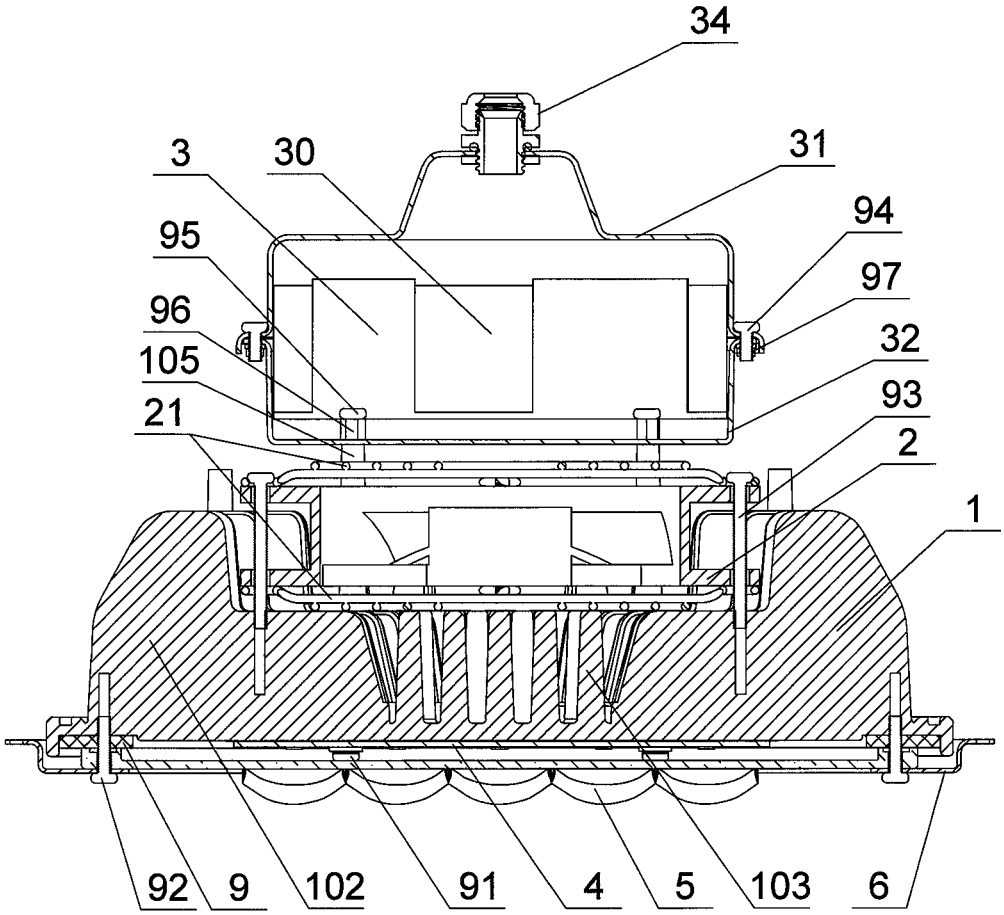
FIG. 3 is a cross-section diagram of the dustproof and waterproof multipurpose LED-light power source assembly.
Figure 4:
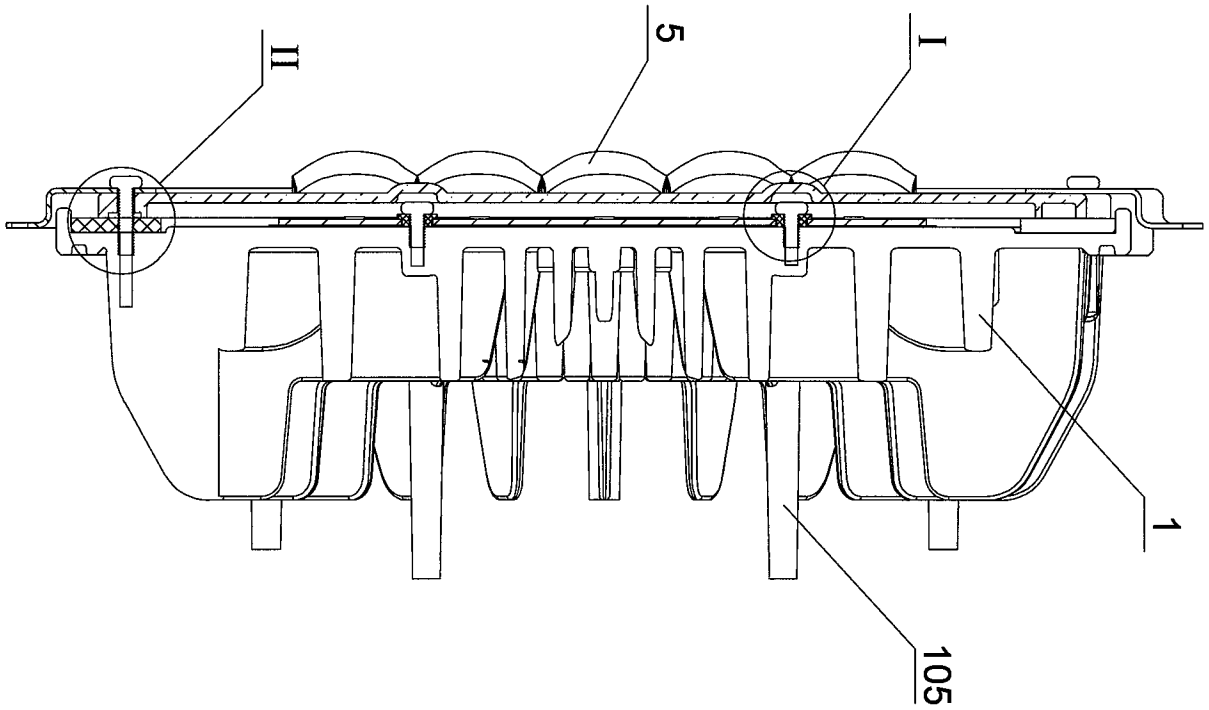
FIG. 4 is a cross-section diagram of the heat sink and light source portion of the dustproof and waterproof multipurpose LED-light power source assembly.
Figure 5:
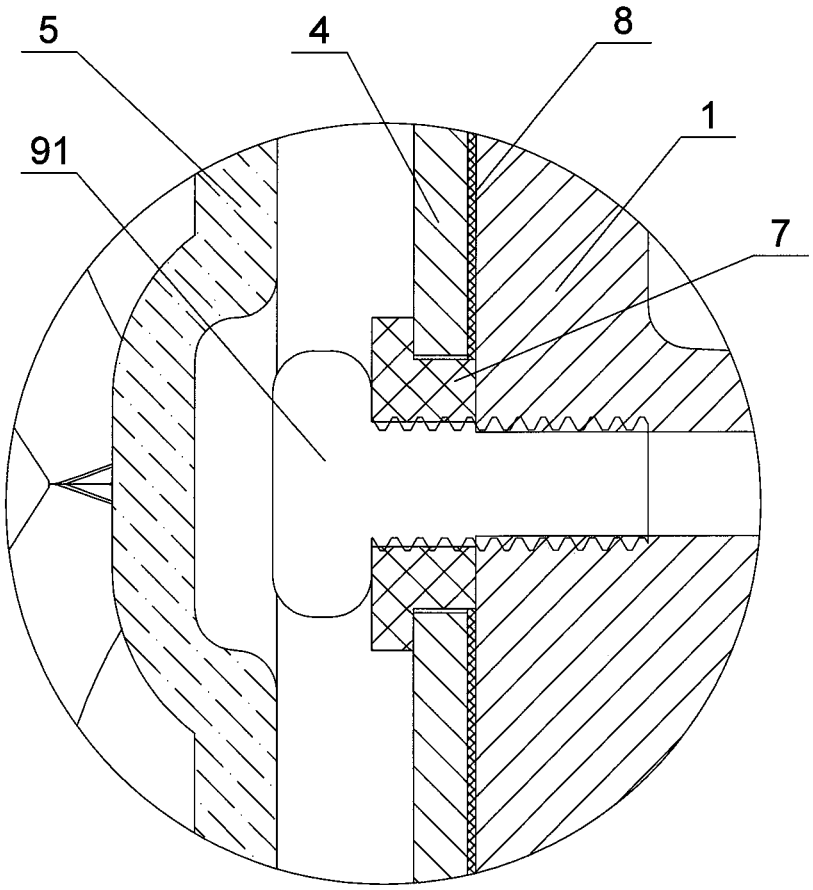
FIG. 5 is a partially enlarged diagram of I shown in FIG. 4.
Figure 6:
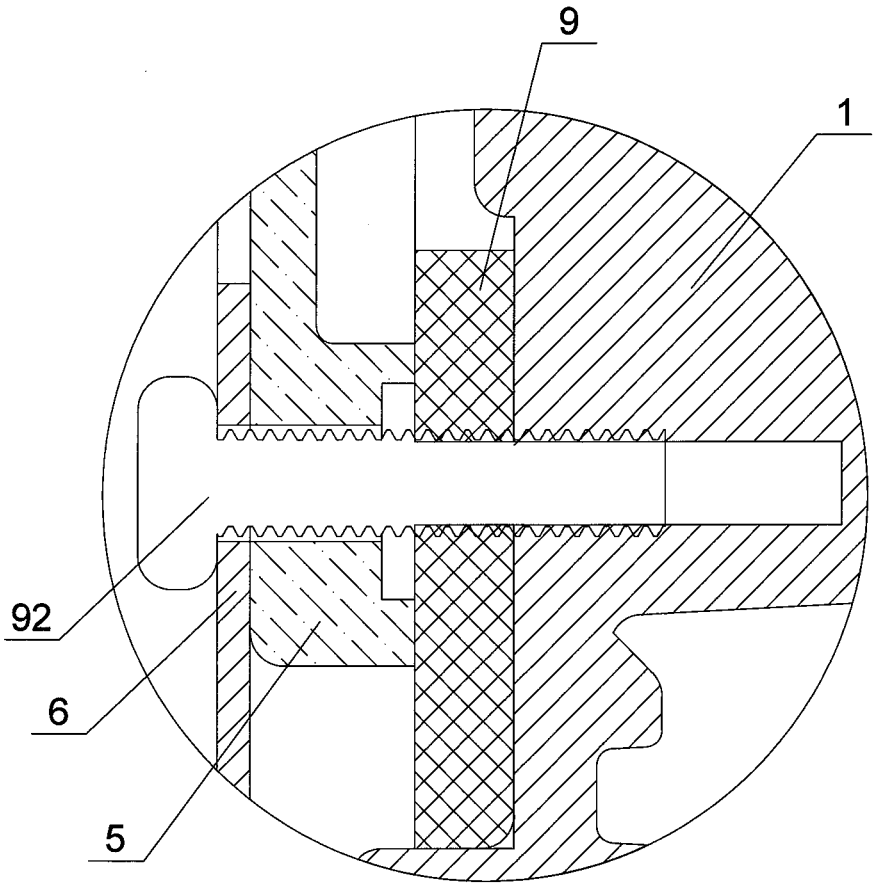
FIG. 6 is a partially enlarged diagram of II shown in FIG. 4.

As shown in FIG. 1 to FIG. 6, the dustproof and waterproof multipurpose LED-light power source assembly according to the embodiment comprises a heat sink 1, a cooling fan 2, a driving circuit board module 3, an LED light source module 4, an insulating annular panel 30, a power supply box top cover 31, a power supply box bottom cover 32, a lens 5, a decorative ring 6, a synthetic mica sheet (8), and a waterproof bolt assembly 34, wherein the LED light source module 4 comprises a plurality of LED chips and an LED heat dissipation substrate; the cooling fan 2 is dustproof and waterproof; the heat sink 1 has a circular outer contour, and comprises a base plate 101 with a round flat bottom surface and a top surface having a heat dissipation portion of which the central top is provided with a space area for accommodating the cooling fan 2; the heat dissipation portion comprises a plurality of outer heat dissipation members 102 in the top margin of the base plate 101 and a plurality of inner heat dissipation members 103 in the top center of the base plate 101, the outer heat dissipation members 102 being sheet-like and being radially arranged along the base plate 101 with air passages formed between adjacent outer heat dissipation members 102 while the inner heat dissipation members (103) being needle-like to increase cooling channels and improve heat dissipation; the inlet and outlet of the cooling fan 2 are respectively provided with a fan net 21 to proof the fan, in a specific connection mode where four third screws 93 successively pass through the fan net 21 above the cooling fan 2, the cooling fan 2, and the fan net 21 below the cooling fan 2 to get fixedly connected to the heat sink 1; the power supply box top cover 31 and the power supply box bottom cover 32 are both round in accordance with the outer contour of the heat sink 1; the power supply box top cover 31 is sealedly connected to the power supply box bottom cover 32 to enclose the driving circuit board module 3, and a waterproof sealant is applied to the seam between the power supply box top cover 31 and the power supply box bottom cover 32 which are connected specifically by four fourth screws 94 and four nuts 97; the insulating annular panel 30 is positioned in a space sealedly formed by the power supply box top cover 31 and the power supply box bottom cover 32, and the driving circuit board module 3 is positioned within the insulating annular panel 30, so that the power driving portion is insulated from the power supply box top cover 31 and the power supply box bottom cover 32 in a better way; the waterproof bolt assembly 34 is connected to the top of the power supply box top cover 31; the power supply box bottom cover 32 is positioned above the cooling fan 2 and is fixedly connected to the heat sink 1, four support columns 105 protruding from the heat dissipation portion are provided on the back of the heat sink 1 to support the power supply box bottom cover 32, the support column 105 is 10-50 mm higher than the upper surface of the cooling fan 2 so that the power supply box bottom cover 32 is spaced from the cooling fan 2, and air circulation at the input and output of the fan is enhance in a specific connection mode where four bolts 96 having internal threads in the leading end and external threads in the trailing end pass through the power supply box bottom cover 32 to get fixedly connected to the support columns 105, four fifth screws 95 pass through the driving circuit board module 3 to get fixedly connected to the internal threads in the leading ends of the bolts 96, an insulation treatment is conducted where the fifth screw 95 passes through the driving circuit board module 3, and the leading end of the bolt 96 with internal threads has a height of 5-10 mm to meet the requirements for insulation and creepage distance between the driving circuit board module 3 and the power supply box bottom cover 32; the LED heat dissipation substrate is fixedly connected with the base plate 101 to conduct heat for dissipation, in a specific way that the LED heat dissipation substrate and the base plate 101 are fixed together by four first screws 91, insulating rubber particles 7 are provided where the first screws 91 are used to fix the connection to insulate the LED heat dissipation substrate from the first screws 91 and the base plate 101 so that the insulation is enhanced and the creepage distance is increased for safety requirements, and a synthetic mica sheet 8 is placed between the LED heat dissipation substrate and the base plate 101, with an edge exceeding that of the LED heat dissipation substrate by 1-10 mm; and the decorative ring 6 and the lens are fixedly connected to the bottom of the heat sink 1 specifically by second screws 92 with a silicone waterproof gasket 9 provided where the lens 5 is connected to the bottom of the heat sink 1, so as to further improve waterproof performance of the light source portion.

In the dustproof and waterproof multipurpose LED-light power source assembly according to the present invention, the power supply box top cover 31 is sealedly connected with the power supply box bottom cover 32 to enclose the driving circuit board module 3, and the waterproof bolt assembly 34 is connected to the top of the power supply box top cover 31, therefore the power line can be sealed by the waterproof bolt assembly 34 to proof the power supply portion against dust and water; in addition, the fan portion is insulated from dust and water as the cooling fan is dustproof and waterproof; the light source portion is also dustproof and water proof by fixedly connecting the decorative ring and the lens to the bottom of the heat sink; thereby the dustproof and waterproof multipurpose LED-light power source assembly, as a whole, is insulated from water and dust, and can be used as a primary element in street lamps, ceiling lamps, downlights, or high bay lights for outdoor lighting or locations like dusty workshops and plants. Heat dissipation of the lamp is combined with active and passive cooling by integrating the cooling fan 2 with the heat sink 1, which is highly efficient and helps to effectively improve stability of the lamp and extend service life of the lamp. The synthetic mica sheet is placed between the LED heat dissipation substrate and the base plate 101, which is a sheet-like insulating material produced by pressing mica papers made of mica raw materials together with adhesives under high temperature and high pressure. The synthetic mica sheet is excellent in thermal conductivity, flame resistance and electric insulation with advantages such as uniform thickness, adjustable area, and great flexibility and workability. It has a thermal conductivity of 5 W/(m·K)-24 W/(m·K), which is higher than that of a thermal silicone grease or a thermal insulating cloth. Besides, the mica sheet has a fixed shape and a high average uniformity, and contacts with the LED heat dissipation substrate and the base plate 101 in a tighter and more uniform way, so it has a better thermal conductivity and a better insulativity, and is easy to install with a high production efficiency. With the edge of the mica sheet 8 exceeding the edge of the LED heat dissipation substrate by 1-10 mm, the requirement for creepage distance between the LED heat dissipation substrate and the heat sink 1 is met for safety. To sum up, the dustproof and waterproof multipurpose LED-light power source assembly according to the present invention is easy to install and has a high production efficiency, great thermal conductivity and insulativity as well as excellent dustproof and waterproof effects, and thus can be used in many ways.

When the dustproof and waterproof multipurpose LED-light power source assembly according to the present invention works for lighting, the cooling fan 2 works simultaneously, the heat generated from the radiant LED chips is conducted to the heat sink 1 through the LED heat dissipation substrate and the synthetic mica sheet 8, the heat sink 1 dissipates part of the heat into the air in the same way that a heat sink of the prior art is passively cooled, and at the same time, the cooling fan 2 functions to force the ambient air to flow through the heat sink 1 and carry off the heat. Heat dissipation in such a way has an excellent effect, by which the LED chips are prevented from operating at high temperatures in favor of longer service lives. Existence of forced cooling allows the heat sink 1 to have a reduced size and weight, and makes the lamp more applicable.

Figure 7:
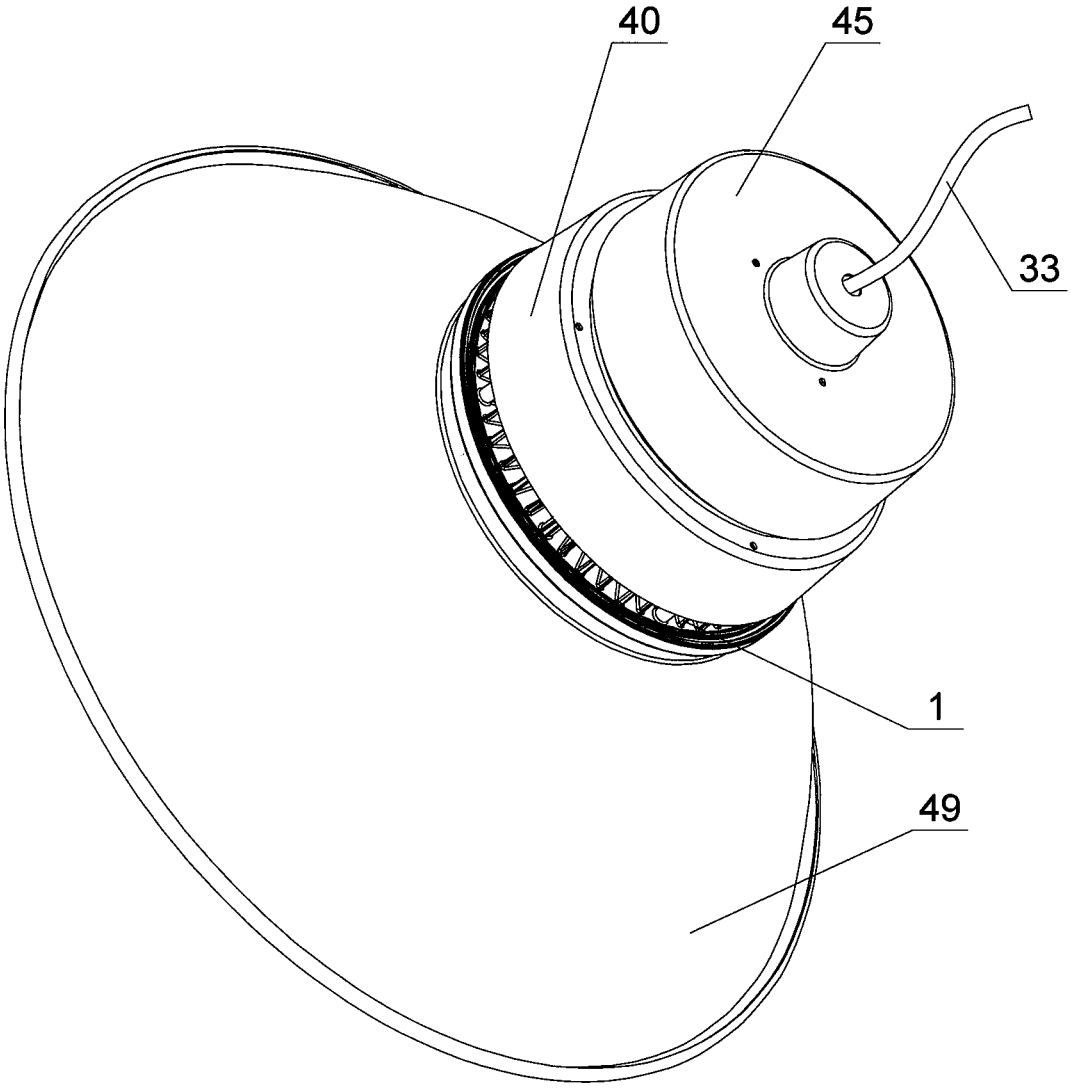
FIG. 7 is a three-dimensional structure diagram of a dustproof and waterproof LED light implementing the present invention.
Figure 8:
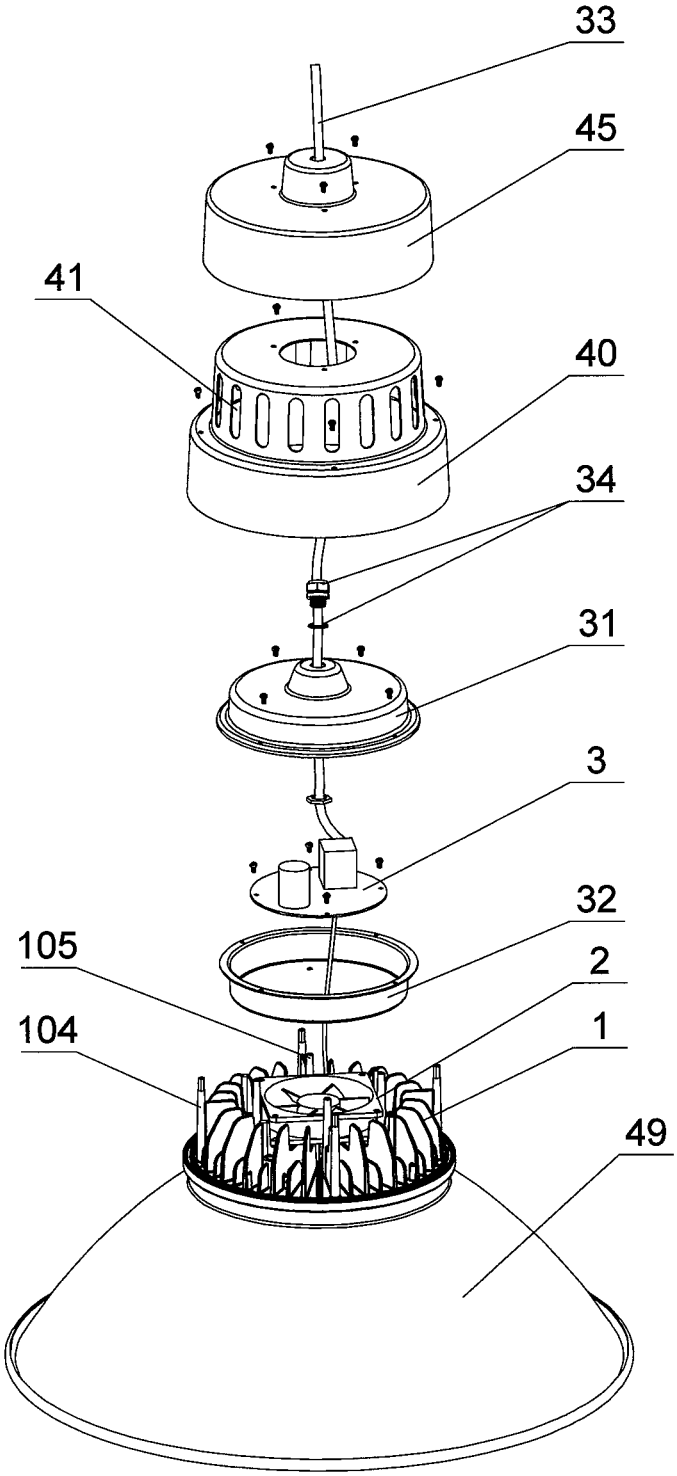
FIG. 8 is an exploded diagram of the dustproof and waterproof LED light.
Figure 9:
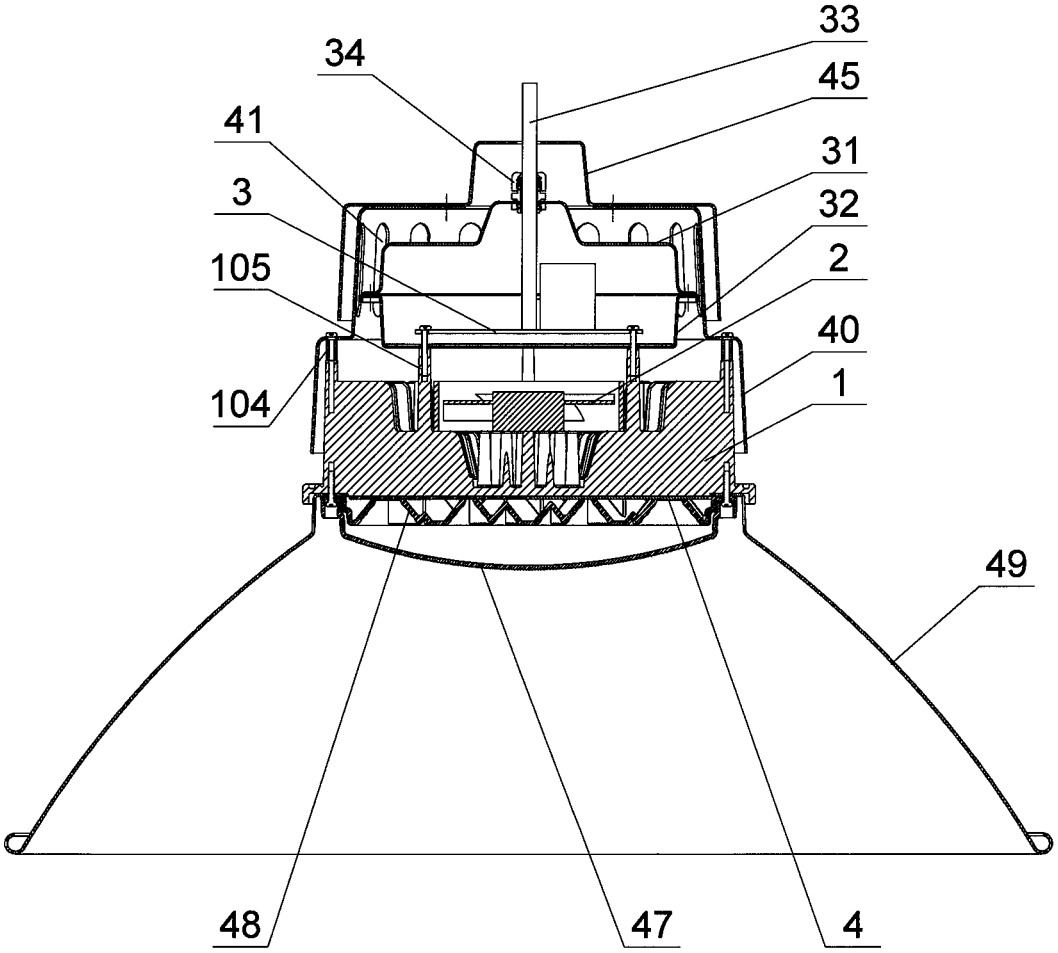
FIG. 9 is a cross-section diagram of the dustproof and waterproof LED light.
Figure 10:
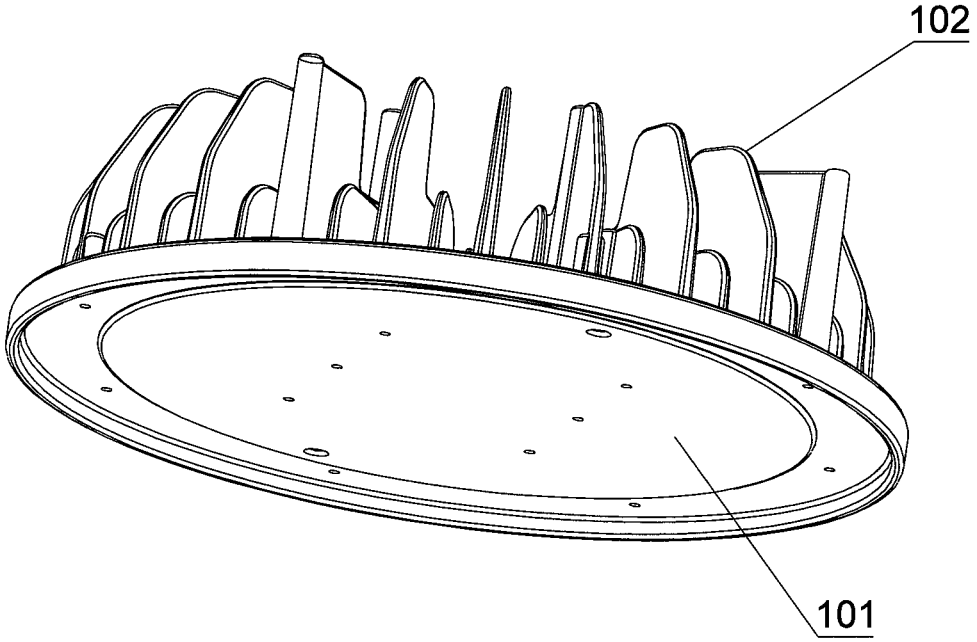
FIG. 10 is a three-dimensional structure diagram of the heat sink of the dustproof and waterproof LED light.
Figure 11:
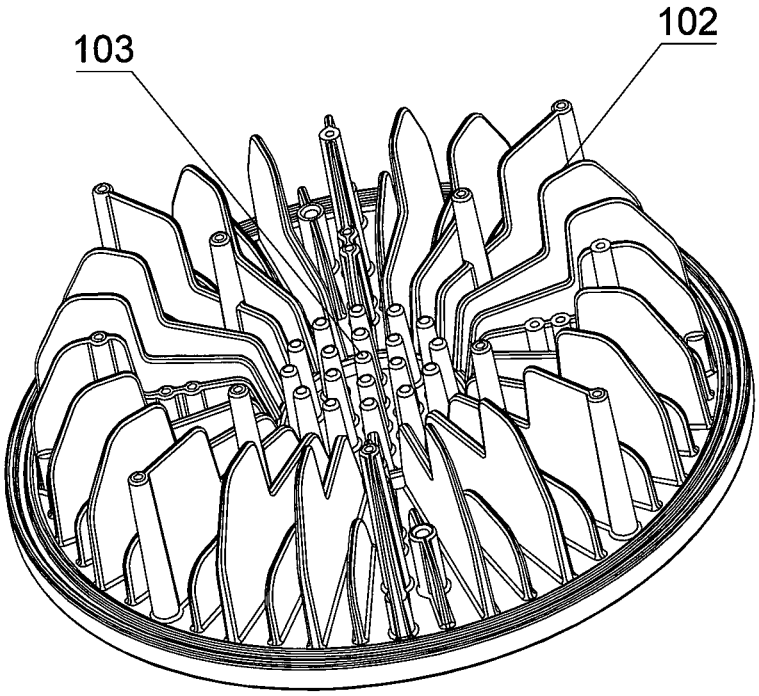
FIG. 11 is a three-dimensional structure diagram of the heat sink shown in FIG. 10 at a different angle.

As FIG. 7 to FIG. 11 shows, the dustproof and waterproof LED light according to the embodiment comprises an LED light source module 4, a driving circuit board module 3, a heat sink 1, a cooling fan 2, an air guide housing 40, a power supply box top cover 31, a power supply box bottom cover 32, a top cover 45, a transparent protective casing 47, a reflector 48, a lampshade 49, and a power line 33; the LED light source module 4 comprises a plurality of LED chips and an LED heat dissipation substrate; the reflector 48 is positioned in front of the light emitting part of the LED light source module 4 and comprises a plurality of reflective surfaces corresponding to the LED chips; the LED heat dissipation substrate contacts with the heat sink 1 and conducts heat for dissipation; the power supply box bottom cover 32 is positioned above the cooling fan 2 and is fixedly connected to the heat sink 1; the power supply box top cover 31 and the power supply box bottom cover 32 are both round in accordance with the outer contour of the heat sink 1; the power supply box top cover 31 is sealedly connected with the power supply box bottom cover 32 to enclose the driving circuit board module 3 with a waterproof sealant applied to the seam between the two; the air guide housing 40 is fixedly connected to the heat sink 1 to enclose in its cavity the cooling fan 3, the power supply box top cover 31, the power supply box bottom cover 32 and the space above the heat sink 1; the air guide housing 40 is provided with a plurality of air guide apertures 41 on the upper sidewall, the top cover 45 is fixedly connected to the air guide housing 40 to laterally enclose the air guide apertures 41 that communicates with the outside air through an opening around the bottom of the top cover 45, so that the air flow is guided, flow passages are increased and heat dissipation is improved; the power line 33 successively passes through the top cover 45, the air guide housing 40 and the power supply box top cover 31 to get electrically connected to the driving circuit board module 3 and then passes through the power supply box bottom cover 32 to get electrically connected to the cooling fan 2 and the LED light source module 4; a waterproof bolt assembly 34 sealedly fixes where the power line 33 passes through the power supply box top cover 31; a waterproof sealant sealedly fixes where the power line 33 passes through the power supply box bottom cover 32; the cooling fan 2 is dustproof and waterproof; the transparent protective casing 47 and the lampshade 49 are fixedly connected to the bottom of the heat sink 1 to enclose the LED light source module 4; a waterproof sealant is applied to the seam between the skirt of the bottom of the transparent protective casing 47 and the heat sink 1 to proof the LED light source module 4 in the transparent protective casing 47 against water and dust; the skirt of the bottom of the transparent protective casing 47 caps the margin of the bottom of the lampshade 49, and the transparent protective casing 47 and the lampshade 49 is connected to the heat sink 1 by bolts; the heat sink 1 has a circular outer contour, and comprises a base plate 101 with a round flat bottom surface and a top surface having a heat dissipation portion of which the central top is provided with a space area for accommodating the cooling fan 2, the heat dissipation portion comprising a plurality of outer heat dissipation members 102 in the top margin of the base plate 101 and a plurality of inner heat dissipation members 103 in the top center of the base plate 101, the outer heat dissipation members 102 being sheet-like and being radially arranged along the base plate 101 with air passages formed between adjacent ones while the inner heat dissipation members (103) being needle-like with crisscrossing air flow channels formed among them in favor of great heat dissipation; a plurality of first connecting posts 105 and second connecting posts 104 are provided on the base plate 101 of the heat sink 1; the driving circuit board module 3 and the power supply box bottom cover 32 are successively connected to the first connecting posts 105 by bolts; the air guide housing 40 is connected to the second connecting posts 104 by bolts; and the power supply box top cover 31 is connected to the power supply box bottom cover 32 by bolts, the same way as the top cover 45 is connected to the air guide housing 40.

In the dustproof and waterproof LED light according to this invention, the power supply box top cover 31 is sealedly connected with the power supply box bottom cover 32 to enclose the driving circuit board module 3, the waterproof bolt assembly 34 sealedly fixes where the power line 33 passes through the power supply box top cover 31, and a waterproof sealant sealedly fixes where the power line 33 passes through the power supply box bottom cover 32, so that the driving circuit board module 3 is sealed by the power supply box top cover 31 and the power supply box bottom cover 32 so as to become waterproof and dustproof; moreover, the cooling fan 2 is waterproof; thereby the power supply portion of the whole lamp is sealed and insulated from water and dust, and is rid of risks such as entering of insects; and thus the lamp can be used outdoors or for locations like dusty workshops and plants. Heat dissipation of the lamp is combined with active and passive cooling by integrating the cooling fan 2 with the heat sink 1, which is highly efficient and helps to effectively improve stability of the lamp and extend service life of the lamp. In a word, the present invention has great cooling and waterproof effects and can be applied for indoor or outdoor high bay lights.

When the dustproof and waterproof LED light according to the present invention works for lighting, the cooling fan 2 works simultaneously, the heat generated from the radiant LED chips is conducted to the heat sink 1 through the LED heat dissipation substrate, and the heat sink 1 conducts part of the heat to the lampshade 49 and directly or indirectly dissipates the heat into the air in the same way that a heat sink of the prior art is passively cooled. In the meantime, by the action of the cooling fan 2, ambient air enters the cavity of the air guide housing 40 via the air guide apertures 41, flows from the inner heat dissipation members 103 to the outer heat dissipation members 102, and flows outside through the gap at the bottom of the heat sink 1. The heat of the heat sink 1 is taken away thanks to the air circulation forced by the cooling fan 2, and heat dissipation in such a way has an excellent effect, by which the LED chips are prevented from operating at high temperatures in favor of longer service lives. Existence of forced cooling allows the heat sink 1 to have a reduced size and weight, and makes the lamp more applicable.

This invention can be widely used in the field of LED lighting.

The invention claimed is:

1. A dustproof and waterproof multipurpose LED-light power source assembly comprising:

a heat sink;

a cooling fan;

a driving circuit board module;

an LED light source module;

a power supply box top cover;

a power supply box bottom cover;

an air guide housing;

a top cover;

a power line; and a waterproof bolt assembly;

wherein the LED light source module comprises a plurality of LED chips and an LED heat dissipation substrate, the cooling fan is dustproof and waterproof, the heat sink comprises a base plate with which the LED heat dissipation substrate is fixedly connected to conduct heat for dissipation, the base plate has a flat bottom surface and a top surface with a heat dissipation portion of which the central top is provided with a space area for accommodating the cooling fan, the power supply box bottom cover is above the cooling fan and is_fixedly connected with the heat sink, the power supply box top cover is sealingly connected with the power supply box bottom cover to enclose a driving circuit board module;

the waterproof bolt assembly is connected to the top of the power supply box top cover;

the air guide housing is fixedly connected to the heat sink to enclose in its cavity the cooling fan, the power supply box top cover, the power supply box bottom cover and the space above the heat sink, the air guide housing is provided with a plurality of air guide apertures on the upper sidewall, the top cover is fixedly connected to the air guide housing to laterally enclose the air guide apertures that communicate with the outside air through an opening around the bottom of the top cover, the power line successively passes through the top cover, the air guide housing and the power supply box top cover so as to electrically connect to the driving circuit board module and then passes through the power supply box bottom cover so as to electrically connected to the cooling fan and the LED light source module, a waterproof bolt assembly is sealingly fixed where the power line passes through the power supply box top cover, and a waterproof sealant is sealingly fixed where the power line passes through the power supply box bottom cover.

2. The dustproof and waterproof multipurpose LED-light power source assembly according to claim 1, wherein the heat sink has a circular outer contour, the heat dissipation portion comprises a plurality of outer heat dissipation members at the top margin of the base plate and a plurality of inner heat dissipation members at the top center of the base plate, the outer heat dissipation members are sheet-like and are radially arranged along the base plate, air passages are formed between adjacent outer heat dissipation members, and the inner heat dissipation members are needle-like.

3. The dustproof and waterproof multipurpose LED-light power source assembly according to claim 1, wherein a synthetic mica sheet is placed between the LED heat dissipation substrate and the base plate, with an edge exceeding that of the LED heat dissipation substrate by 1-10 mm.

4. The dustproof and waterproof multipurpose LED-light power source assembly according to claim 1, wherein the LED heat dissipation substrate and the base plate are fixed together by a plurality of first screws, and insulating rubber particles are provided where the first screws are used to fix the connection so as to insulate the LED heat dissipation substrate from the first screws and the base plate.

5. The dustproof and waterproof multipurpose LED-light power source assembly according to claim 1, further comprising:

an insulating annular panel in a space sealingly formed by the power supply box top cover and the power supply box bottom cover, wherein the driving circuit board module is positioned within the insulating annular panel.

6. The dustproof and waterproof multipurpose LED-light power source assembly according to claim 1, further comprising:

a lens;

a decorative ring; and a silicone waterproof gasket that is_provided where the lens is connected to the bottom of the heat sink, wherein the lens and decorative ring are both fixedly connected to the bottom of the heat sink by second screws.

7. The dustproof and waterproof multipurpose LED-light power source assembly according to claim 1, wherein the inlet and outlet of the cooling fan are respectively provided with a fan net, and a plurality of third screws that successively pass through the fan net above the cooling fan, the cooling fan, and the fan net below the cooling fan so as to fixedly connect to the heat sink.

8. The dustproof and waterproof multipurpose LED-light power source assembly according to claim 1, wherein the power supply box top cover and the power supply box bottom cover are both round, and a waterproof sealant is applied to the seam between the two.

9. The dustproof and waterproof multipurpose LED-light power source assembly according to claim 1, wherein at least two support columns protruding from the heat dissipation portion are provided on the back of the heat sink to support the power supply box bottom cover, a plurality of bolts-having internal threads in the leading end and external threads in the trailing end pass through the power supply box bottom cover so as to fixedly connect to the support columns, a plurality of fifth screws pass through the driving circuit board module so as to fixedly connect to the internal threads in the leading ends of the bolts, the support column is 10-50 mm higher than the upper surface of the cooling fan, and the leading end of the bolt with internal threads has a height of 5-10 mm.

10. The dustproof and waterproof LED light according to claim 1, further comprising:

a transparent protective casing and a lampshade, both of which are fixedly connected to the bottom of the heat sink to enclose the LED light source module, wherein the skirt of the bottom of the transparent protective casing caps the margin of the bottom of the lampshade so that the transparent protective casing and the lampshade can be connected to the heat sink by bolts, and a waterproof sealant is applied to the seam between the skirt of the bottom of the transparent protective casing and the heat sink.

* * * * *